United States Patent [19]

Syska

[11] 3,990,831

[45] Nov. 9, 1976

[54] RECIRCULATING BURNER

[75] Inventor: Andrew J. Syska, Marblehead, Mass.

[73] Assignee: Consolidated Natural Gas Service Co., Inc., Pittsburgh, Pa.

[22] Filed: Sept. 4, 1975

[21] Appl. No.: 610,250

[52] U.S. Cl. ..... 431/9; 431/11; 431/116

[51] Int. Cl.[2] ..... F23M 3/00

[58] Field of Search ..... 431/115, 116, 9, 11, 431/215; 432/21

[56] References Cited

UNITED STATES PATENTS

| | | | |
|---|---|---|---|
| 1,839,512 | 1/1932 | Waterman | 431/115 |
| 2,216,178 | 10/1940 | Astradsson | 431/11 |
| 3,620,657 | 11/1971 | Robinson | 431/9 |
| 3,652,194 | 3/1972 | Bailey | 431/9 |

*Primary Examiner*—Edward G. Favors

[57] ABSTRACT

A burner for burning a vaporizable liquid fuel, comprising a suction chamber, a combustion chamber, an air inlet to the suction chamber, a vaporizing chamber, a first passage interconnecting the combustion chamber with the vaporizing chamber, a second passage interconnecting the vaporizing chamber with the suction chamber, a liquid fuel inlet atomizer connected to the vaporizing chamber, and a vortex generator at the interface of the fuel inlet atomizer, first passage, and vaporizing chamber, the generator swirling hot combustion gases from the first passage into a vortex, into which vortex the fuel inlet atomizer directs atomized liquid fuel, the first passage, vortex generator, vaporizing chamber, and second passage together defining a recirculation path, the path having sufficient width to maintain blue-flame combustion, whereby the fuel will be vaporized by hot combustion gases as it passes through the vortex generator and the vaporizing chamber, the air inlet creating a suction which draws hot combustion gases and vaporized fuel from the vaporizing chamber through the second passage and suction chamber, thereby producing a mixture for burning in the combustion chamber.

14 Claims, 2 Drawing Figures

10
13
15
13a
13b
36a
33a
25
19
15b
15a
38
26
12
1
1
36a
18
33
33
32
27
36
36a
28
19a
20

10
13
15
11
AIR
40
33
33a
41
24
15b
48
13b
13a
14
11a
16
32
33a
22
15a
12
33a
17
32
27
29
26
19a
2
2
38
33a
42
46
25
OIL
19
20
46
42
20a
18
33
33
36
34

RECIRCULATING BURNER

BACKGROUND OF THE INVENTION

This invention relates to recirculating liquid fuel burners.

It is known to use recirculated hot combustion gases to vaporize liquid fuel, such as oil, for blue-flame, smoke-free, and quiet combustion. It has been said that the percent recirculation should be at least 50%, for maintaining blue-flame combustion, but that the percent recirculation necessary increases with the percent excess air used. American Petroleum Institute Publication 1723-A, January, 1965, pp. 2–4, esp. FIG. 1. "Blue-flame combustion", as the term is used hereinafter, will refer to the "Region of clean, blue-flame, quiet combustion" labeled on FIG. 1 of this API publication, reprinted as FIG. 1 of the U.S. patent application of Alex F. Wormser entitled "Recirculating Burner", filed Aug. 22, 1975, Ser. No. 606,841, and hereby incorporated by reference herein. Reichhelm et al. U.S. Pat. No. 3,705,784 and Reichhelm U.S. Pat. No. 3,361,183 teach introducing liquid oil into the flow of recirculated hot gases, the driving force for recirculation being provided by suction owing to ejector action by incoming air, although the former patent specifies recirculation of only a small portion of the gases. Complete vaporization of the oil is desired to attain blue-flame operation, and effective mixing of recirculated hot gases with the liquid fuel is a desirable method of achieving complete vaporization and avoiding unwanted condensation of liquid fuel on the walls of burner apparatus. Von Linde U.S. Pat. No. 3,174,526 teaches spraying atomized liquid fuel into recirculated hot combustion gases in a prechamber slightly upstream of the sites for mixing with air and burning. Bailey U.S. Pat. No. 3,652,194, in a system in which the fuel is premixed with oxidant air before being mixed with a minor proportion of recirculated hot gases, teaches generating vortices at the combustion area by making the burner leg square in cross section, for improved mixing of hot gases with the fuel-air mixture. Thermal Research & Engineering Corp. of Conshohocken, Pa., offers an internally recirculating burner utilizing tangential entry of inlet air to create a vortex to draw back the hot combustion gases (Bulletin No. 143, pp. 6–7).

SUMMARY OF THE INVENTION

The invention provides a safe, clean, simple, sturdy, compact, easy-to-assemble and install, convenient-to-use, and versatile recirculating liquid fuel burner capable of producing blue-flame, smoke-free, and quiet combustion.

The invention provides a burner having a turndown range up to 4.5:1 and capable of maintaining blue-flame combustion throughout the range. The burner can also easily burn gaseous fuels, such as natural gas. There are few parts making up the burner apparatus. Vaporization of the liquid fuel is complete, unwanted condensation of the fuel along the burner walls is prevented, and combustion is thereby made more efficient. Start-up is efficient, without waste of oil, and does not require complex or cumbersome starting equipment. High flame temperatures can be achieved for a variety of industrial applications such as forging and glass melting.

The invention features a burner for burning a vaporizable liquid fuel, comprising a housing, a suction chamber in the housing, a combustion chamber in the housing, the combustion chamber having an inlet and an outlet, a mixing chamber in the housing between the suction chamber and a diffuser, the diffuser connecting the mixing chamber and the combustion chamber inlet, an air inlet to the suction chamber for directing air under pressure into the suction chamber, a vaporizing chamber, the vaporizing chamber having an inlet from the combustion chamber and an outlet, a first passage interconnecting the combustion chamber with the vaporizing chamber inlet, a second passge interconnecting the vaporizing chamber outlet with the suction chamber, a vaporizable liquid fuel inlet atomizer connected to the vaporizing chamber at the vaporizing chamber inlet, and a vortex generator at the interface of the fuel inlet atomizer, the first passage, and the vaporizing chamber inlet, the generator swirling hot combustion gases from the first passage into a vortex, into which vortex the fuel inlet atomizer is adapted to direct atomized liquid fuel, the first passage, vortex generator, vaporizing chamber, and second passage together defining a recirculation path for hot combustion gases from the combustion chamber to the suction chamber, the path having sufficient width to provide in conjunction with the air inlet enough recirculation to maintain blue-flame combustion, whereby the fuel will be vaporized by the hot combustion gases as it passes through the vortex generator and through the vaporizing chamber, the air inlet creating a suction which draws hot combustion gases and vaporized fuel from the vaporizing chamber through the second passage and suction chamber into the mixing chamber for mixing with the air, thereby producing a combustible mixture for burning in the combustion chamber.

Preferred embodiments feature a vortex generator comprising a throat and a generally tubular vortex chamber, the fuel inlet atomizer being connected to one end of the vortex chamber, the vaporizing chamber inlet being connected to the other end of the vortex chamber, the throat interconnecting the first passage and the vortex chamber along the wall of the vortex chamber between the ends of the chamber, the throat being directed into the vortex chamber tangentially of the chamber, and the fuel inlet atomizer comprising a nozzle which produces in the vortex chamber a generally conical spray of atomized liquid fuel, whereby the hot combustion gases are accelerated through the throat to form the vortex in the vortex chamber and the vortex swirls about the conical spray of fuel, providing improved vaporization thereof; an air inlet which includes a nozzle within the suction chamber, the nozzle creating suction for drawing the hot combustion gases and vaporized fuel into the suction chamber and then into the mixing chamber; gating means positioned within the first and second passages, the gating means being movable into two positions, a first open position wherein the passages are unobstructed, leaving the recirculation path unobstructed, for use of liquid fuel, and a second closed position wherein the passages are blocked, cutting off the recirculation path, for use of gaseous fuel; a housing which comprises two sections, a first burner section containing the air inlet, the suction chamber, the mixing chamber, the diffuser, the combustion chamber, and a gaseous inlet into the suction chamber, and a second recirculation section containing the vortex generator, liquid fuel inlet atomizer, and vaporizing chamber, the sections when connected together defining the first and second passages, and said second section being removable when the first section is used for combustion of gaseous fuel; first and second passages which are cylindrical and two inches in diameter, a vaporizing chamber which is at least as wide as the passages, and a combustion chamber which is cylindrical and 3½ inches in diameter at the widest portion thereof; and a variable rate at which liquid fuel is sprayed through the fuel nozzle into the vortex chamber, a variable rate at which air is directed through the air inlet into the air mixing chamber, and a burner turndown range up to 4.5:1.

Other advantages and features of the invention will be apparent from the description and drawings herein of a preferred embodiment thereof.

DESCRIPTION OF THE PREFERRED EMBODIMENT

Figure 2:
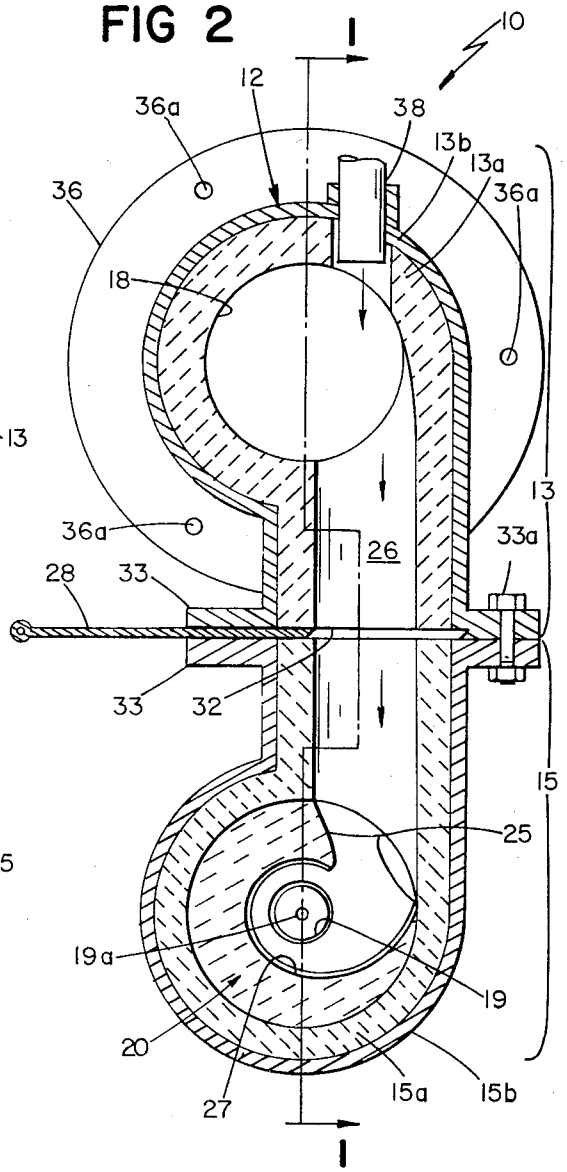
FIG. 2 is a view through 2—2 of FIG. 1.
Figure 1:
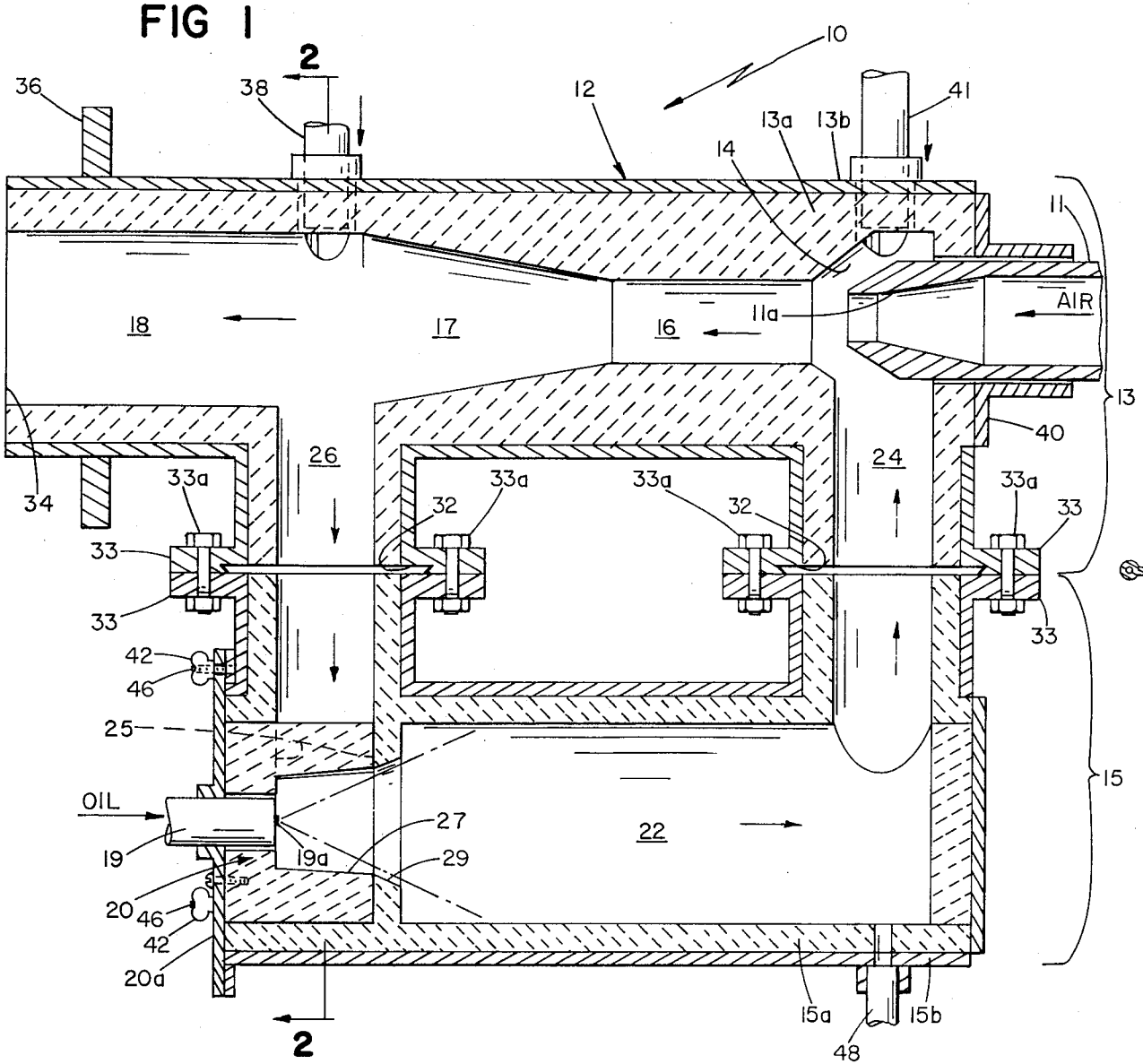
FIG. 1 is a side view, in cross section, of one embodiment of the invention.

FIG. 1 shows burner 10, comprising housing 12, air inlet 11, suction chamber 14, cylindrical mixing chamber 16, frustoconical diffuser 17, cylindrical combustion chamber 18, oil inlet nozzle 19, vortex generator 20, cylindrical vaporizing chamber 22, and cylindrical passages 24 and 26, passage 24 interconnecting vaporizing chamber 22 with air inlet 11 and suction chamber 14, and passage 26 interconnecting combustion chamber 18 with vortex generator 20 and vaporizing chamber 22. Passages 24 and 26, vortex generator 20, and vaporizing chamber 22 together provide a recirculation path, as will be explained in more detail below. Gates 28 (FIG. 2) slidably fit into grooves 32 in upper flanges 33 surrounding passages 24 and 26 to block flow through these passages when inserted; when gates 28 are pulled out of grooves 32, as shown in FIG. 2, unrestricted flow is permitted through both passages.

Housing 12 comprises burner section 13 and recirculation section 15, the sections being composed, respectively, of inner refractories **13*a* and 15*a*, of 3000° F. heat-resistant concrete, and outer metal piping 13*b* and 15*b*. Sections 13 and 15 are held together by bolts 33*a* between upper and lower flanges 33, the two sections together completing passages 24 and 26. Burner 10 is mounted on a furnace, boiler or other heating receptacle by means of flange 36 surrounding and spaced inward from the combustion chamber outlet 34. Outlet 34 is inserted into a hole in the furnace wall (not shown), and flange 36 bolted to the furnace wall through flange holes 36*a*. Tube 38 permits a pilot light to communicate with combustion chamber 18 at burner start-up. Section 15 can be demounted from section 13 by removal of bolts 33*a* from flanges 33, if prolonged use of gas fuel is desired, making section 15 unnecessary. Gates 28 are slid into grooves 32 in upper flanges 33 to block flow out of the upper halves of passages 24 and 26**.

Passage 26 (2 inches in diameter), connected to combustion chamber 18 (inner diameter 3½ inches), carries hot, burned gases from chamber 18 to vortex generator 20. Vortex generator 20 comprises constricted throat 25 and frustoconical vortex chamber 27. Throat 25 extends from passge 26, and is connected to chamber 27 transversely to the chamber axis (FIG. 2), the lower portion of throat 25 being curved to intersect chamber 27 tangentially thereto. Separate frustoconical chamber guide 29, flared more than chamber 27, has an imaginary vertex angle of 50°. Oil inlet nozzle 19 carries liquid fuel from an oil source into vortex chamber 27. Nozzle pin **19*a* atomizes the liquid fuel into a fine spray in the form of a cone having a 50° vertex angle projecting into chamber 27. Hot gases from combustion chamber 18 coming through passage 26 and throat 25 are accelerated, and swirl tangentially into a vortex about the oil spray cone in chamber 27. The term "vortex" as used throughout this application, when referring to gases, means not simply a swirling motion of the gases but a tangential acceleration of the gases to provide an accelerated swirling motion. Vortex generator 20 can be removed as a unit from burner 10 by removal of end plate 20*a*, plate 20*a* being secured to piping 15*b* along flanged portions of both by wing nuts 42 secured to studs 46 protruding from the flanged portion of piping 15*b*. Should condensation of fuel occur, drainage nipple 48**, positioned near the vaporizing chamber outlet, will remove such fuel.

Air inlet 11, upon entering suction chamber 14, terminates with nozzle **11*a*. Air under pressure enters suction chamber 14 through nozzle 11*a*, this jet of incoming air creating in passage 24 a suction, which draws the gaseous contents of vaporizing chamber 22 (4 inches in diameter) through passage 24 (2 inches in diameter) into suction chamber 14. Inlet 11 can be removed from burner 10 by removal of end plate 40**.

Operation in the start-up and full-running modes will now be described. In start-up, air under pressure is admitted into burner 10 through inlet 11. A pilot light is permitted to communicate with combustion chamber 18 through tube 38. The air passes through suction chamber 14, mixing chamber 16, diffuser 17, and combustion chamber 18. A portion of the air is drawn into passage 26 by the suction created by nozzle **11*a* and then into vortex generator 20. In generator 20, the air first enters throat 25 where it is accelerated by the constricted throat design, and passes into vortex chamber 27. Oil is then admitted in atomized form through nozzle 19 and nozzle pin 19*a* into chamber 27 as a fine spray in a 50° cone, pin 19*a* determining the cone angle. The air from throat 25 enters chamber 27 transversely to the direction of the oil spray and tangentially to the spray cone. The air swirls through chamber 27 in the form of a vortex, and the oil-bearing air then passes out through chamber guide 29 into vaporizing chamber 22. The swirling air assists in vaporizing the oil. Suction created by nozzle 11*a* in passage 24 draws the air-oil mixture through vaporizing chamber 22, up through passage 24, into the flow of air from nozzle 11*a* in suction chamber 14, through mixing chamber 16, where further mixing occurs, into diffuser 17, where velocity head is converted into pressure head, and into combustion chamber 18, where the mixture is ignited by the pilot light in tube 38. The pilot light is shut off after ignition. Combustion occurs in chamber 18, diffuser 17** providing flame stablization.

In full operation, part of the gaseous products of combustion leaves burner 10 through outlet 34, but part is drawn into passage 26 by the suction created by nozzle **11*a*. These hot combustion gases enter vortex generator 20, passing through throat 25, where they are accelerated into vortex chamber 27. The hot gases whirl in the form of a vortex around the cone of oil mist, as did the recirculating air in start-up, and vaporize the oil, preventing the oil from condensing on the walls of vortex chamber 27 or vaporizing chamber 22**.

This hot gas-oil vortex passes out of chamber 27 through guide 29 into varporizing chamber 22, where vaporization of the oil by the hot gases continues. Chamber 22 is kept below the temperature required to crack the hydrocarbon fuel (usually 900° F.), because the heat required to vaporize the liquid fuel comes from the hot gases, leaving them cooler, through chamber 22 stays above the fuel vaporization temperature (usually 600° F.). Suction created by nozzle 11*a* draws the hot gas-vaporized oil mixture from chamber 22 through passage 24 and suction chamber 14 into mixing chamber 16, where the mixture is further mixed with the jet of incoming air. The hot gas-oil-air mixture then passes through diffuser 17 to be burned in chamber 18. Combustion occurs with a blue flame, and is quiet and smoke-free. Fuel consumption is variable, with a turndown range (the ratio of maximum fuel rate in gph to minimum fuel rate in gph) of 4.5:1 and blue flame operation throughout. One simply adjusts the amount of spray through nozzle 19 and air through inlet 11 to obtain the desired rate of consumption within the permitted range. Fuel and air inputs can be stoichiometric, though excess air can vary up to at least 200%.

In full operation as above described, passages 24 and 26, vortex generator 20 and vaporizing chamber 22 are all wide enough to provide, in conjunction with air inlet 11, (which, with suction chamber 14, mixing chamber 16, and diffuser 17 acts as a jet pump), a percent recirculation sufficient to maintain blue-flame combustion, which, with no excess input air, would be at least 50% under standard conditions, i.e., 1 atmosphere of pressure and 70° F., where percent recirculation, R, is defined as follows:

$$R = \frac{\text{standard } cmf \text{ of recirculated combustion products}}{\text{standard } cmf \text{ of stoichiometric input air}} \times 100$$

The inner width of these parts, which together define the recirculation path, is large enough to sustain this large amount of recirculation flow.

When the desired fuel is a gas, such as natural gas, recirculation is unnecessary, since the fuel does not need to be vaporized. Gates 28 are slid fully into grooves 32 to block passages 24 and 26, thus preventing recirculation. Only burner section 13 is thus used, and gaseous fuel is admitted through inlet 41 into suction chamber 14 tangentially to air entering through nozzle 11*a*. For prolonged use in the gas mode, recirculation section 15 can be demounted and removed from burner 10, as previously described.

In an even more preferred embodiment of the invention, vortex generator 20 is made rotatable about the axis of vortex chamber 27. Three wing nuts 42 connect end plate 20*a* to piping 15*b* through curved slots (not shown) in end plate 20*a* by being threaded onto studs 46 protruding from the flanged end portion of piping 15*b*. When the nuts are loosened, end plate 20*a* and the rest of vortex generator 20 connected thereto can be rotated enough with respect to piping 15*b* and stationary chamber guide 29 to move throat 25 wholly out of alignment with passage 26, interposing the generator housing in the path of passage 26, and thereby blocking flow through this passage, for use of the burner in the gas mode. Nuts 42 are then tightened, maintaining this blocking position. This use of the vortex generator to block recirculation makes gates 28 unnecessary. Rotatability of the vortex generator for shutting off recirculation was the invention of Henry J. Young and is fully disclosed in his U.S. patent application, "Recirculating Burner", filed September 12, 1975, Ser. No. 612,670. The contents of said Young application are hereby incorporated herein by reference.

Other modifications include a vertex angle from 30° to 50° for the oil spray cone.

Spraying atomized liquid fuel into the flow of recirculating hot gases in a separate vaporizing chamber, to vaporize before the atomized fuel reaches a wall was the invention of Alex F. Wormser, whose U.S. patent application, "Recirculating Burner", was filed Aug. 22, 1975, Ser. No. 606,841, and the contents of which are hereby incorporated herein by reference.

Other embodiments are within the following claims.

What is claimed is:

1. A liquid fuel burner for burning a vaporizable liquid fuel comprising:

a housing, a suction chamber in said housing, a combustion chamber in said housing, said combustion chamber having an inlet and an outlet, a mixing chamber in said housing between the suction chamber and a diffuser, said diffuser connecting the mixing chamber and the combustion chamber inlet, an air inlet to said suction chamber for directing air under pressure into said suction chamber, a vaporizing chamber, said vaporizing chamber having an inlet from said combustion chamber and an outlet, a first passage interconnecting said combustion chamber with said vaporizing chamber inlet, a second passage interconnecting said vaporizing chamber outlet with said suction chamber, a vaporizable liquid fuel inlet atomizer connected to said vaporizing chamber at said vaporizing chamber inlet, and a vortex generator at the interface of said fuel inlet atomizer, said first passage, and said vaporizing chamber inlet, said generator swirling hot combustion gases from said first passage into a vortex, into which vortex said fuel inlet atomizer is adapted to direct atomized liquid fuel, said first passage, said vortex generator, said vaporizing chamber, and said second passage together defining a recirculation path for hot combustion gases from said combustion chamber to said suction chamber, said path having sufficient width to provide in conjunction with said air inlet enough recirculation to maintain blue-flame combustion, whereby said fuel will be vaporized by said hot combustion gases as it passes through said vortex generator and through said vaporizing chamber, said air inlet creating a suction which draws said hot combustion gases and said vaporized fuel from said vaporizing chamber through said second passage and suction chamber into said mixing chamber for mixing with said air, thereby producing a combustible mixture for burning in said combustion chamber.

2. The burner of claim 1 wherein said vortex generator comprises a throat and a generally tubular vortex chamber, said fuel inlet is connected to one end of said vortex chamber, said vaporizing chamber inlet is connected to the other end of said vortex chamber, said throat interconnects said first passage and said vortex chamber along the wall of said vortex chamber between the ends of said chamber, said throat is directed into said vortex chamber tangentially of said chamber, and said fuel inlet comprises a nozzle which produces in said vortex chamber a generally conical spray of atomized liquid fuel, whereby said hot combustion gases are accelerated through said throat to form said vortex in said vortex chamber, and said vortex swirls about said conical spray of fuel, providing improved vaporization thereof.

3. The burner of claim 1 wherein said air inlet includes a nozzle within said suction chamber, said nozzle creating said suction for drawing said hot combustion gases and said vaporized fuel into said suction chamber and then into said mixing chamber.

4. The burner of claim 1 wherein gating means are positioned within said first and second passages, said gating means being movable into two positions, a first open position wherein said passages are unobstructed, leaving said recirculation path unobstructed, for use of said liquid fuel, and a second closed position wherein said passages are blocked, cutting off said recirculation path, for use of gaseous fuel.

5. The burner of claim 1 wherein said housing comprises two sections, a first burner section containing said air inlet, said suction chamber, said mixing chamber, said diffuser, and said combustion chamber, and a gaseous fuel inlet into said suction chamber, and a second recirculation section containing said vortex generator, said liquid fuel inlet atomizer, and said vaporizing chamber, said sections when connected together defining said first and second passages, and said second section being removable when said first section is used for combustion of gaseous fuel.

6. The burner of claim 1 wherein said first and second passages are cylindrical and two inches in diameter, said vaporizing chamber is cylindrical and at least as wide as either of said passages, and said combustion chamber is cylindrical and 3½ inches in diameter at the widest portion thereof.

7. The burner of claim 2 wherein the rate at which said liquid fuel is sprayed through said fuel nozzle into said vortex chamber is variable, the rate at which air is directed through said air inlet into said suction chamber is variable, and said burner has a turndown range up to 4.5:1.

8. In a liquid fuel burner for burning a vaporizable liquid fuel comprising a housing, a suction chamber in said housing, a combustion chamber in said housing, said combustion chamber having an inlet and an outlet, a mixing chamber in said housing between the suction chamber and a diffuser, said diffuser connecting the mixing chamber and the combustion chamber inlet, an air inlet to said suction chamber for directing air under pressure into said suction chamber, a vaporizing chamber, said vaporizing chamber having an inlet from said combustion chamber and an outlet, a first passage interconnecting said combustion chamber with said vaporizing chamber inlet, a second passage interconnecting said vaporizing chamber outlet with said suction chamber, and a vaporizable liquid fuel inlet atomizer connected to said vaporizing chamber at said vaporizing chamber inlet, said first passage, said vaporizing chamber, and said second passage together defining a recirculation path for hot combustion gases from said combustion chamber to said suction chamber, whereby said liquid fuel will be vaporized by said hot combustion gases as it passes through said vaporizing chamber, said air inlet creating a suction which draws said hot combustion gases and said vaporized fuel from said vaporizing chamber through said second passage and said suction chamber into said mixing chamber for mixing with said air, thereby producing a combustible mixture for burning in said combustion chamber, the improvement which comprises:

a vortex generator connected at the interface of said fuel inlet, said first passage, and said vaporizing chamber inlet, said generator swirling hot combustion gases from said first passage into a vortex, into which vortex said fuel inlet atomizer is adapted to direct atomized liquid fuel, for improved vaporization of said fuel, and said recirculation path having sufficient width to provide in conjunction with said air inlet enough recirculation to maintain blue-flame combustion.

9. The burner of claim 8 wherein said vortex generator comprises a throat and a generally tubular vortex chamber, said fuel inlet is connected to one end of said vortex chamber, said vaporizing chamber inlet is connected to the other end of said vortex chamber, said throat interconnects said first passage and said vortex chamber along the wall of said vortex chamber between the ends of said chamber, said throat is directed into said vortex chamber tangentially of said chamber, and said fuel inlet atomizer comprises a nozzle which produces in said vortex chamber a generally conical spray of atomized liquid fuel, whereby said hot combustion gases are accelerated through said throat to form said vortex in said vortex chamber, and said vortex swirls about said conical spray of fuel, providing said improved vaporization.

10. The burner of claim 8 wherein said air inlet includes a nozzle adjacent to said air mixing chamber, said nozzle creating said suction for drawing said hot combustion gases and said vaporized fuel into said suction chamber and then into said mixing chamber.

11. A method of burning vaporizable liquid fuel comprising the steps of:

a. introducing air under pressure into a suction chamber from a source of said air, b. drawing vaporizable liquid fuel into said suction chamber from a source of said fuel by suction created by said introducing step (a), c. mixing said air and said fuel in a mixing chamber connected downsteam of said suction chamber to produce a combustible mixture, d. introducing said mixture into a combustion chamber through a diffuser, e. burning said combustible mixture in said combustion chamber, f. taking an amount of hot combustion gases produced by said burning sufficient to maintain blue-flame combustion and swirling said gases into a vortex, g. introducing atomized vaporizable liquid fuel into said vortex of hot combustion gases, h. vaporizing said fuel by the heat of said gases in a vaporizing chamber, to produce a vaporized fuel-hot gas mixture, i. introducing air under pressure into said suction chamber, j. drawing said vaporized fuel-hot gas mixture into said suction chamber and then into said mixing chamber by suction created by said introducing step (i), k. mixing said vaporized fuel-hot gas mixture with said air in said mixing chamber to produce a combustible mixture, and l. repeating steps (d) through (k).

12. The method of claim 11 wherein said introducing steps (a) and (i) are performed through a nozzle, to create said suction, which provides the power to perform step (f) and step (j).

13. The method of burning vaporizable liquid fuel which comprises the steps of introducing atomized vaporizable liquid fuel into a vaporizing chamber, recirculating from adjacent an outlet end of a combustion chamber through a first passage to an inlet end of said vaporizing chamber an amount of hot combustion gases sufficient to produce from the outlet of said combustion chamber a blue flame, swirling said hot combustion gases into a vortex surrounding said atomized liquid fuel, thereby to vaporize said fuel before it reaches a wall, and introducing air in a manner to drive gases from said vaporizing chamber through a second passage to said combustion chamber, causing burning in said combustion chamber.

14. A liquid fuel burner comprising:

a combustion chamber, a suction chamber, a vaporization chamber, a first passage from said combustion chamber to said vaporization chamber, a second passage from said vaporization chamber to said combustion chamber, combustible gas delivery means at said suction chamber, liquid fuel delivery means into said vaporization chamber, and a vortex generator at the interface of said vaporization chamber, said first passage, and said liquid fuel delivery means.

* * * * *